United States Patent [19]

Oehler et al.

[11] Patent Number: 5,015,938

[45] Date of Patent: May 14, 1991

[54] SYNCHRONIZABLE DRIVE SYSTEM

[75] Inventors: Reinhard Oehler, Berg am Irchel; Urs Meyer, Niederglatt; Andre Lattion, Seuzach, all of Switzerland

[73] Assignee: Rieter Machine Works, Ltd., Winterthur, Switzerland

[21] Appl. No.: 373,461

[22] Filed: Jun. 30, 1989

[30] Foreign Application Priority Data

Jul. 6, 1988 [CH] Switzerland ..... 02571/88

[51] Int. Cl.[5] ..... D01H 15/02; H02P 1/46

[52] U.S. Cl. ..... 318/696; 318/705; 318/706; 318/41; 318/43; 57/263; 192/150

[58] Field of Search ..... 318/700, 705, 706, 711, 318/713, 717, 719, 723, 799, 268, 272, 696, 254, 35, 39, 41, 43, 47, 50, 62, 85; 57/263, 100, 92; 192/150

[56] References Cited

U.S. PATENT DOCUMENTS 3,946,298 3/1976 Van de Loo ..... 318/696
4,249,369 2/1981 Tsuzuki et al. ..... 57/263
4,520,909 6/1985 Brewer ..... 192/150
4,774,805 10/1988 Wood et al. ..... 57/263

FOREIGN PATENT DOCUMENTS 2104116 3/1983 United Kingdom .

OTHER PUBLICATIONS

Macaulay, David, "The Way Things Work", 1988, pp. 88–89.

*Primary Examiner*—William M. Shoop, Jr.
*Assistant Examiner*—John W. Cabeca
*Attorney, Agent, or Firm*—Kenyon & Kenyon

[57] ABSTRACT

The drive system connects a servomotor via a clutch to a shaft after the motor has started up from a standstill to a speed in synchronism with the supply frequency to the servomotor. The clutch may also be actuated to disengage the servomotor from the shaft when the servomotor is slowed to a predetermined speed during stopping of the servomotor. A transmission is employed between the servomotor and the shaft to compensate for any shocks to the motor when engaging the clutch.

10 Claims, 4 Drawing Sheets

SYNCHRONIZABLE DRIVE SYSTEM

FIELD OF THE INVENTION

This invention relates to a synchronizable drive system and particularly to a drive system having an electric motor whose speed is controlled by way of a supply frequency, for example, synchronous motors, reluctance motors, speed-controlled or position-controlled asynchronous motors and permanent magnet motors.

BACKGROUND OF THE INVENTION

As is known, electric motors which are controlled by way of a supply frequency are increasingly used in all kinds of textile machinery but are still under discussion for ring spinning machines.

Each individual spinning position of a ring spinning machine comprises three basic operative elements which must be moved, viz. a spindle, a drawframe and a ring carrier or ring bank. An individual spindle is usually associated with the spinning position but the drawframe and the ring bank extend over a number of spinning positions, as a rule, over the whole length of one side of the machine. For the reasons given hereinafter, endeavors have been made to "decentralize" the conventional central drive system of the ring spinning machine which has been in the form of a main driving motor having transmissions to distribute the driving power to the various operative elements.

The main reasons for these endeavors with respect to a single spindle drive are higher productivity, energy saving, noise reduction, higher speeds, and fewer yarn breakages.

For an individual drafting arrangement drive, the reasons are no change gears, simple and rapid control, the possibility of remote control and the possibility of fine adjustment.

When the three operative elements hereinbefore mentioned are considered individually, the endeavors have met with considerable success. A number of "individual drive systems" are available which drive the spindles individually (or in groups) and give the drafting arrangement its own independent drive. The ring bank can be moved either together with the drafting arrangement or by an independent drive. However, despite many such proposals, no individual drive system has yet been introduced in practice. Although the various decentralized drive systems for the spindles, drafting arrangement and ring bank can still be further improved or optimized, the main outstanding problems are the co-operation of these drives with one another and within the drive system of the drawframe, particularly for starting and stopping the machine. Deviations from the programmed speeds are very likely to occur in this phase and endanger the technological parameters of the spun yarn. Making a drive suitable for practical use is therefore a very difficult job. More particularly, the spindles have to be accelerated from a standstill to their operating speed (or brought to a standstill) with a programmed starting slope if yarn breakages are to be avoided. Further, the drafting arrangement (and ring bank) must so move relative to the spindles that no yarn breakages occur and the yarn quality produced during starting (and stopping) corresponds (is as near as possible the same as) the yarn quality produced in normal operation.

A drive system meeting these requirements must also be economic to produce if it is to be able to compete with conventional central drives.

It has long been known, for example, from DOS 2 203 833, that driving motors speed-controlled by way of the supply frequency offer possibilities of solving the problems mentioned. However, drive systems devised for such motors cannot readily meet all requirements. As soon as (or as long as) such a motor runs in synchronism with its supply frequency, the motor can be maintained (within its load limits) in a desired relationship to other such motors. However, a distinctive feature of such motors is that, if the motor is designed with a rational load bearing capacity, the motor either does not start immediately from a standstill (or decelerate to a standstill) in synchronism with the supply frequency and is instead uncontrollable below a critical speed (minimum speed or minimum frequency), and/or the motor cannot produce an adequate and exactly maintained acceleration torque from a standstill. This feature causes problems, particularly in connection with the driving of drafting arrangements, as will be described in greater detail hereinafter.

The drafting arrangement of a ring machine comprises a number of units consisting of cylinder/roller pairs. The inter-unit speed ratios determine compliance with the yarn count while the speed ratio between the front roller unit and the yarn-twisting spindle is decisive for the level of twist in the yarn. The units must start from a standstill and, a stoppage, return to a standstill "with gearwheel accuracy"—i.e., in a predetermined relationship of the angles of rotation. Also, the drafting arrangement requires a minimum starting acceleration because, at stoppage of the machine, the yarns preferably remain connected to the spindles and the spindles restart so rapidly that the yarns are tensioned and form a balloon. If the drafting arrangement cannot accelerate to its working speed fast enough in these conditions, mis-twisting and eventually massive yarn breakages occur. Also, for the same reasons, the rotations of the drafting cylinders and rollers should, at stoppage of the machine, be maintained until stoppage (or until a low speed) of the spindles. But, because of considerable differences between the moment of inertia of the spindles and that of the drafting arrangement, this requirement causes considerable problems.

Preferably, an "individual drafting arrangement drive system" comprises at least one drive for the front roller unit and one drive for the other drafting units and possibly even one drive per unit. The reasons hereinbefore set out make it impossible to embody such drive systems using low-cost motors speed-controlled by way of their supply frequency, without taking further action, to maintain the necessary relationships below a critical speed.

German O.S. 2 849 576 describes a drive system for a ring spinning machine or machines which includes two motors for each drafting unit. In addition, each motor is adapted to be coupled by way of a clutch and a belt connection to the corresponding drawframe unit. The control for these clutches is arranged to produce effects in the yarn; however, the control is not related to synchronization of the motors.

SUMMARY OF THE INVENTION

Accordingly, it is an object of the invention to provide a decentralized drive system for a rotatable load.

It is another object of the invention to provide a drive system of economical construction and operation.

It is another object of the invention to provide a drive system for a ring spinning machine which can be readily synchronized for the operation of various rotatable shafts of the machine.

Briefly, the invention provides a drive system which is comprised of at least one motor, a load for performing a rotary movement from a standstill and to a standstill, controllable means selectively connecting the motor to the load for rotating the load and control means for controlling the speed of the motor in dependence on a supply frequency. The control means is also connected to the controllable means in order to actuate this means to connect the motor with the load in response to the motor being in synchronism with the supply frequency and to disconnect the motor from the load in response to the motor being out of synchronism with the supply frequency.

As described in U.S. Pat. No. 3,936,998, the controllable means may be in the form of a controllable clutch and/or switchable brake and is used to determine the transmissability of the motor speed to the load. In this respect, the drive is characterized in that the control means for the controllable means is such that the motor speed can be transmitted to the load only when the motor has been sychronized with its supply frequency.

The control and the switchable means can be so embodied that the motor speed is monitored and the load is coupled with the motor only when the motor has run up to a minimum speed and has reached synchronism, the load being disconnected from the machine only when the motor is running at a minimum speed at stoppage of the system. Preferably, the motor runs up to speed off-load below this minimum speed The motor speed and the switching of the switchable means can be determined from a common control.

These preferred variants are not essential. For example, at starting, the time which has elapsed from the initiation of an acceleration program could be monitored and the load coupled with the motor only after the predetermined period of time. Disconnecting the load from the motor could proceed correspondingly in accordance with a stoppage program. As another alternative, the motor could be permanently connected to the main load and an additional load such as a brake could be provided so that the motor can drive the main load only when the motor has been freed from the additional load. The removal of the additional load can be devised as hereinbefore described in connection with the provision and cancellation of a connection between the motor and its "operative load".

In a system according to the preferred proposal, a stationary load should be coupled with a motor which has already started and which is running slowly in a synchronized manner. If necessary, a torque transformer can be so provided between the motor and the load that the moment of inertia experienced by the motor when the load is cut in is insufficient to pull the motor out of step with the supply frequency. The torque transformer can be provided by a geared transmission. Advantageously in such a case, a damping load-transferring means, such as a toothed belt transmission, can be provided between the motor and the gearing since in some operating conditions (at low speeds) frequency-controlled three-phase motors emit torque pulses which may damage the geared transmission. As a rule, it is advantageous to provide a speed step-up or step-down of such a kind that the relative speed of the parts to be coupled together is low. The load-transmitting means mentioned can perform the latter function too. If two ratios are provided the switchable means are, with advantage, disposed between them.

The drive system can be used as the drive for at least one unit of a drafting arrangement of a ring spinning machine; preferably, the other units of the same drafting arrangement are driven by a second drive or each by an individual drive according to the present invention, the speeds of the various motors of these drives being transmitted simultaneously to their respective units.

These and other objects of the invention will become more apparent from the following detailed description taken in conjunction with the accompanying drawings wherein:

DESCRIPTION OF THE PREFERRED EMBODIMENTS

Figure 1:
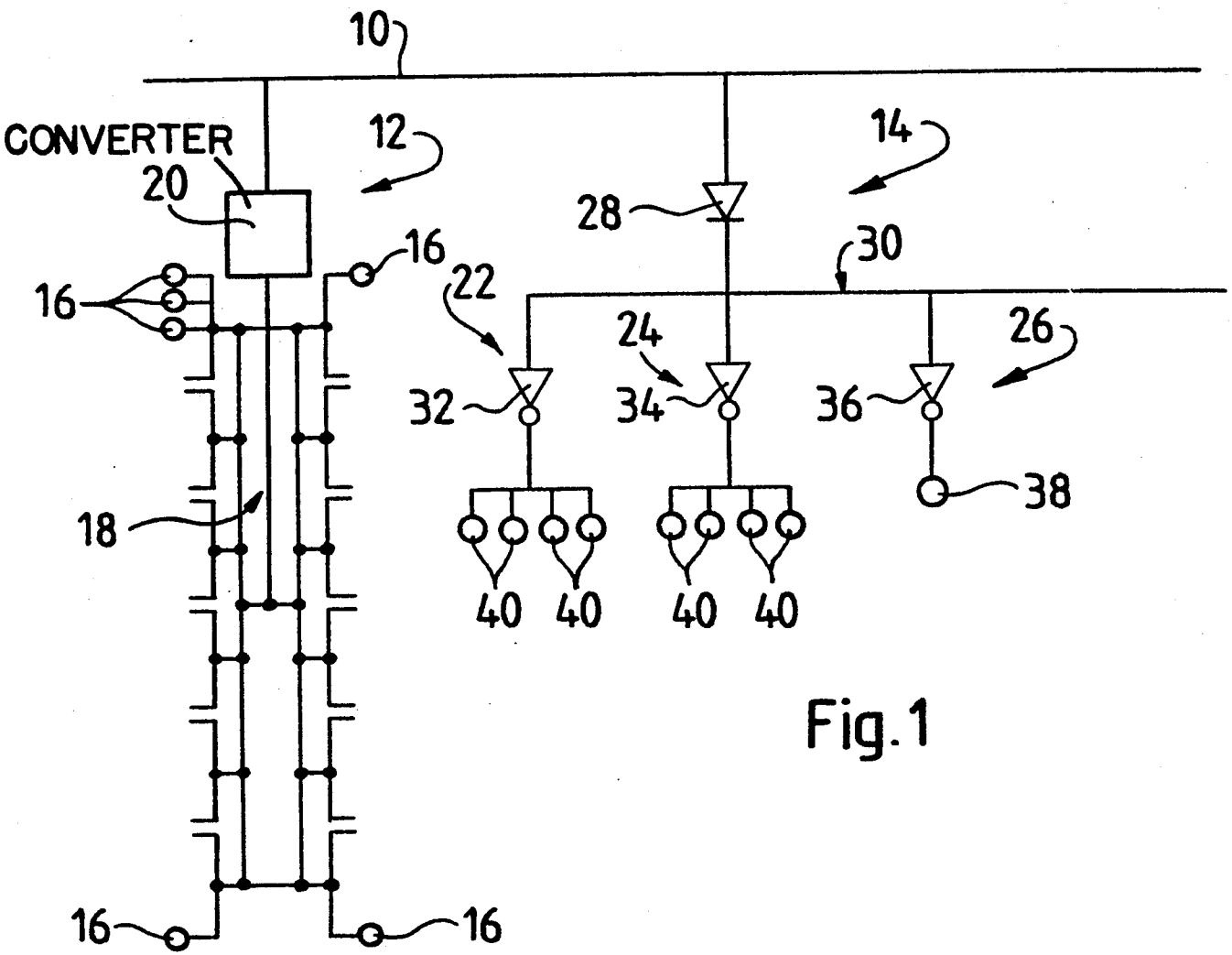
FIG. 1 illustrates a diagrammatic view of various drives for a ring spinning machine.

Referring to FIG. 1, a line 10 extends from electricity supply means (not shown) of a predetermined voltage and frequency and is connected to the drive systems of a ring spinning machine (not shown). In this case, two drive systems are provided in the machine, viz. a first system 12 for the spindle drive and a second system 14 for driving the drafting arrangements and ring bank.

The spindle drive is of secondary importance and will therefore be described only briefly. It is assumed in FIG. 1 that each spindle is driven by an individual electric motor 16. In practice, a modern ring spinning machine may have up to 600 spindles on each side of the machine. The various motors 16 are connected by way of an energy distribution system 18 to a common frequency converter 20 in the end head of the machine. The converter 20 can comprise, for example, a rectifier (not shown) and, connected thereto, an inverter (not shown). The motors 16 can be low-cost motors, for example, asynchronous motors. As already indicated, the control is not limited to such a drive system for the spindles. The spindles could be driven, for example, in groups or even by a single motor by way of tangential belts.

What is important, however, is that there must be no mechanical connection for coupling the speed ratio between the spindles and their associated drafting arrangement. This ratio is determined solely by the electrical control.

The second drive system 14 comprises three different drives 22, 24, 26. These three drives are supplied, by means such as a common rectifier 28 and intermediate dc circuit 30, with power from the line 10. Each drive 22, 24, 26 has an inverter 32, 34, 36 which, in accordance with its own set-value frequency (not specified), converts the dc energy at an input into ac energy of a predetermined frequency at an output.

The drive 26 is of secondary importance, and so, will be briefly described for the sake of greater clarity. The drive 26 is effective to move the ring banks—one ring bank per side of the machine (not shown)—and, to this end, comprises an asynchronous motor 38. The movements of the ring banks relative to the spindles are important for building up cops but present no specially difficult problems to the control and can be neglected in the context of the drive system.

Figure 2:
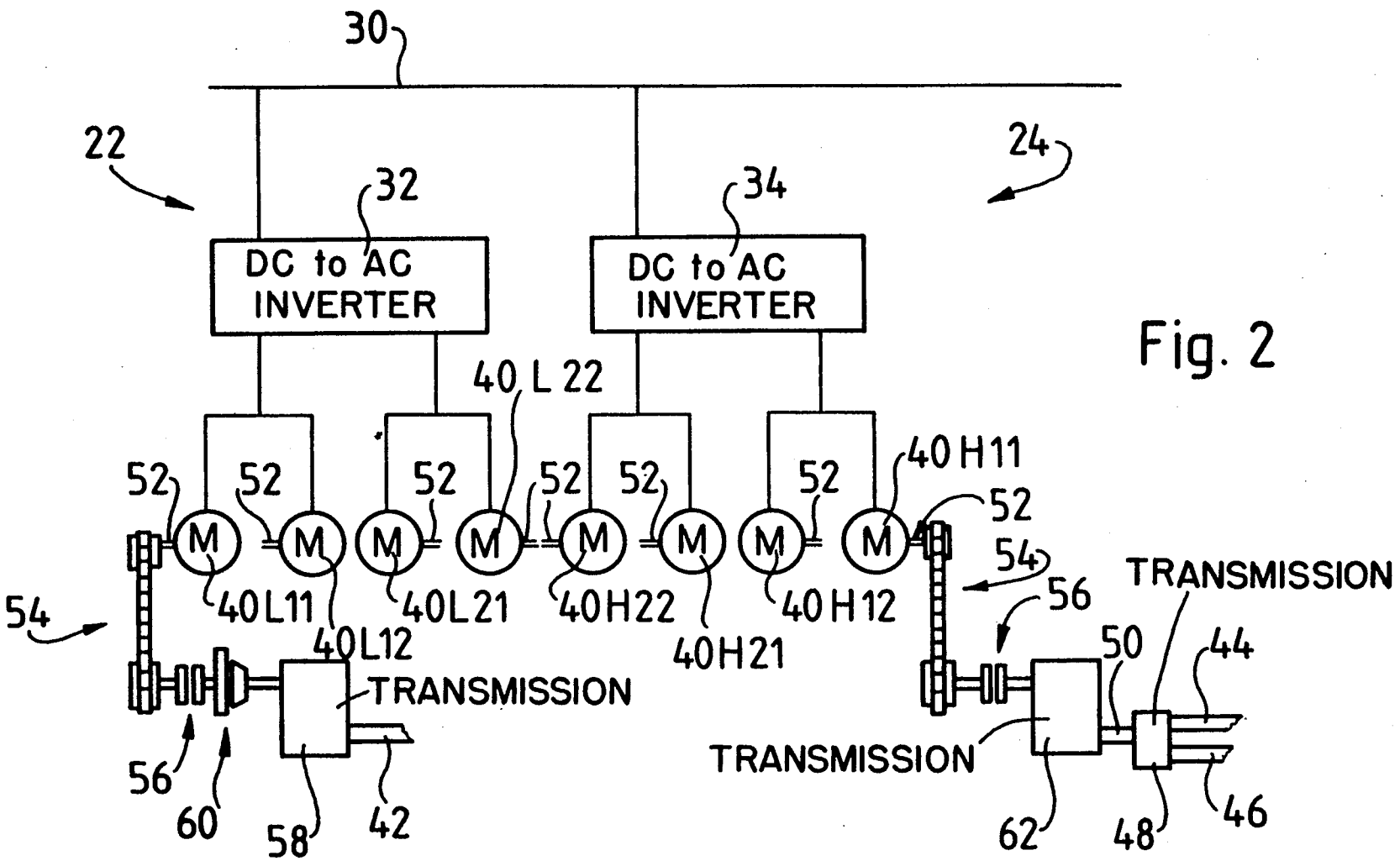
FIG. 2 shows further details of the drives of FIG. 1.

Exactly the contrary is true to drafting arrangement drives 22, 24. Accurate running of the drafting rollers relative to one another is a decisive factor for maintaining the yarn count. Hence, synchronous motors 40 are preferably used in these drives. The arrangements of the drives 22, 24 will now be described in greater detail with reference to FIG. 2. A ring spinning machine normally has two drafting arrangements, one on either side of the machine. Each arrangement comprises a front roller, a middle roller and a back roller. If the machine is long—i.e., having more than 300 spindles on each side of the machine—the rollers are advantageously driven from both ends to prevent defects due to torsion effects in the machine rollers (see, for example, U.S. Pat. Nos. 4,161,862; 4,314,388; 4,568,152 and 3,339,361. An arrangement of this kind is assumed in the example of FIGS. 1 and 2. Correspondingly, two driving motors 40 are provided per front roller (not shown) and all four are supplied by the inverter 32 with electrical power at a controllable frequency. For the sake of clarity in designation, these motors are indicated in FIG. 2 by 40 L 11 (front roller 1, motor 1), 40 L 12 (front roller 1, motor 2), 40 L 21 (front roller 2, motor 1) and 40 L 22 (front roller 2, motor 2). The simple reference 40 is used when the description applies to all these motors.

An end part 42 of the drafting roller, such part being coupled with the motor 40 L 11, is shown as an example. The other motors 40 of the drive 22 are coupled similarly with the corresponding end parts of the drafting rollers. The connection between these motors 40 and their rollers 42 will be described in greater detail hereinafter but a description will first be given of the drive arrangement 24 for the central and back rollers.

FIG. 2 shows an end part 44 of a back roller and the corresponding end part 46 of a middle roller. These rollers are coupled together by a change-speed drive 48 so as to run at a speed ratio to one another predetermined by the transmission 48. The transmission 48 is driven by an input shaft 50 which is coupled, by way of a connection to be described hereinafter, with a motor 40 of the drive 24. Since there are two drafting arrangements, one on the left and on one the right, and the back and middle roller groups are driven from both ends, the drive 24 comprises four synchronous motors 40 like the drive 22 and for the sake of clarity the motors of the drive 24 have the additional references H11, H12, H21 and H22.

A description will now be given of the drive connections between the motors 40 and their respective driven shafts (the parts 42 in the drive 22 and the shafts 50 in the drive 24). Since the connections in any drive (22, 24) are the same, only a single connection will be described for each drive as an example.

In the drive 22, each of the connections comprises a motor shaft 52, a toothed-belt drive 54, a clutch 56 and a geared transmission 58 connected to the part 42. For a purpose to be described hereinafter a brake 60 is disposed between the clutch 56 and the transmission 58.

The connection between the motors 40 of the drive 24 and their corresponding shafts 50 are very similar in various respects and as far as possible like references are used for like elements. Each connection of the drive 24 comprises a motor shaft 52, toothed belt drive 54, clutch 56 and a geared transmission 63 connected to the shaft 50. No brake 60 is necessary in this case. For the sake of simplicity, all the motors 40 are identical and are supplied at the same supply frequency. The transmissions 58, 63 have appropriately different ratios to facilitate the required speed differences between the front roller 42 and the central and back rollers 46, 44.

The brakes 60 in the drive 22 prevent the front rollers 42 from rotating backwards after the machine has been stopped and the clutches 56 disengaged, in order to prevent a yarn defect or a yarn breakage. This feature is known per se but will be described hereinafter in greater detail in connection with the novel clutches 56 and the control thereof.

The toothed belt drive 54 is effective as a damping means which absorb low-speed jerks of the motor 40 and thus protects the delicate geared drive 58 (and 63). The belt drive 54 is also effective to provide a speed change means reducing the relatively high speed of the motor 40 to a lower value at the input of the clutch 56.

The geared transmission 58 or 63 together with the belt drive 54 is effective as a power transmission or torque converter so that when a clutch 56 is engaged, the corresponding motor 40 is not loaded with the high moment of inertia of the stationary rollers 42 or 44, 46.

Figure 3:
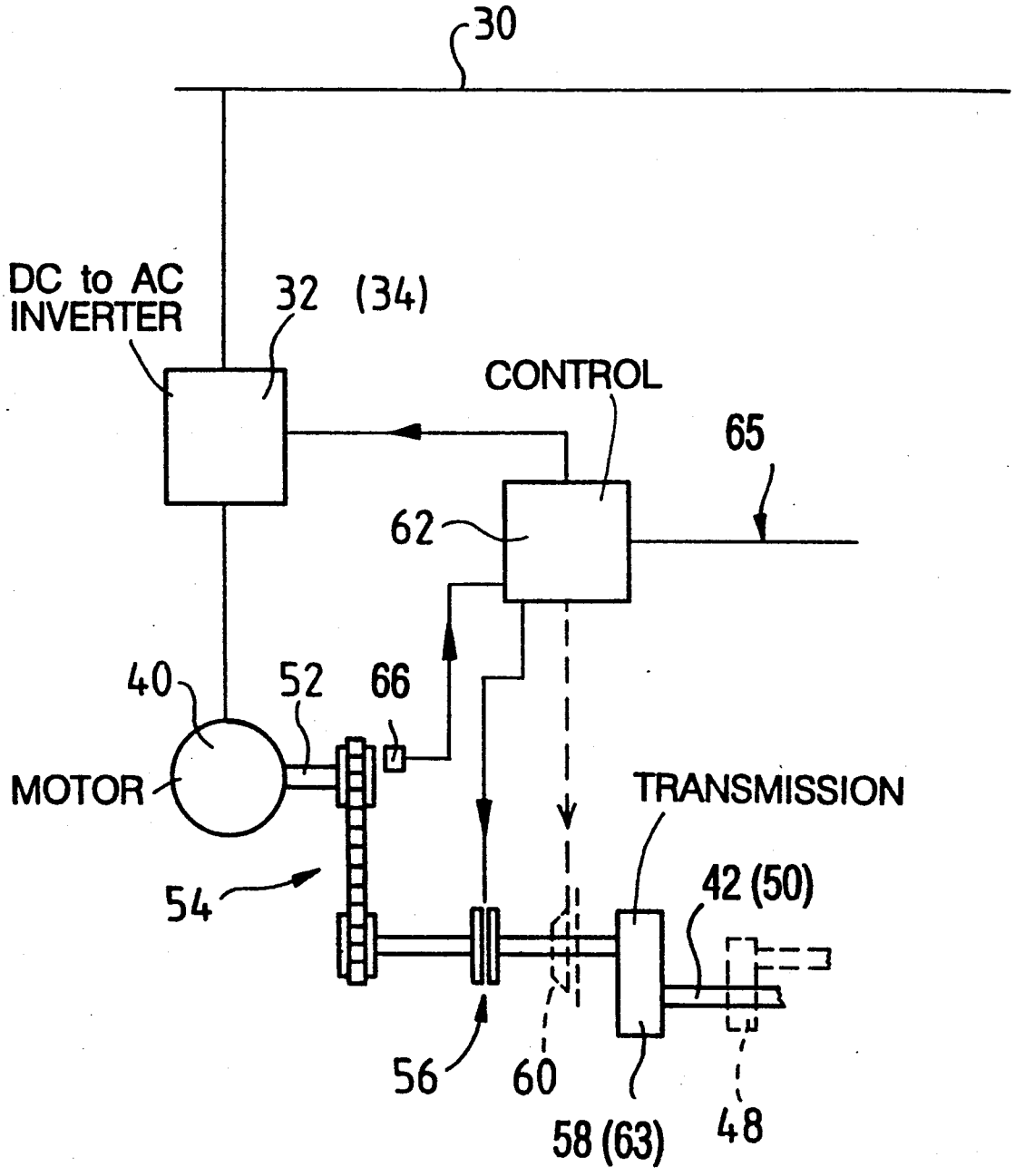
FIG. 3 illustrates a control constructed in accordance with the invention.

The operation of the arrangements shown in FIG. 2 will be described with reference to FIGS. 3 and 4. FIG. 3 representing an example of the connections already described (FIG. 2) between a motor 40 and the shaft 42 or 50 driven thereby. Accordingly, FIG. 3 shows a common control 62 for the inverter 32 (or 34), the clutch 56 and (in the drive 22) the brake 60. The control 62 is energized by way of a line 65; an emergency facility (not shown) for energising the line 65 in the event of a mains failure should be provided so that the machine can run through a predetermined stop program (FIG. 4) in the event of a mains failure as well as in normal operation.

Figure 4:
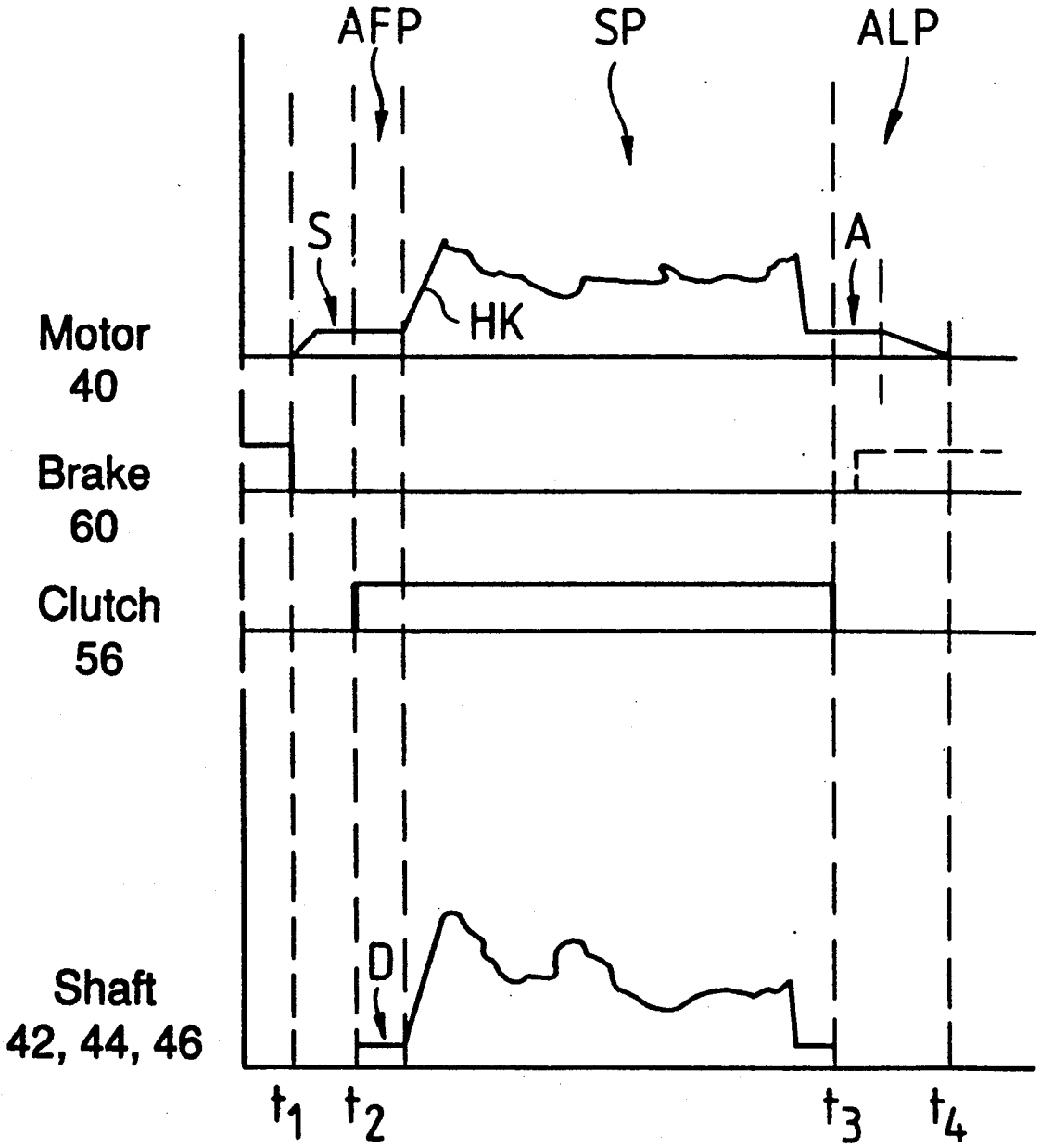
FIG. 4 illustrates a timing diagram for the starting and stopping of a ring spinning machine having a drive system according to this invention.

FIG. 4 shows timing diagrams of the starting phase AFP and stopping phase ALP of the motors 40, brakes 60, clutch 56 and rollers 42, 44, 46. The intermediate spinning phase SP has not been shown since it is of no importance for this invention.

It will be assumed that the drive system 12 (FIG. 1) has started before the time t1 (FIG. 4) so that the yarns (not shown) have been tensioned and the yarn balloons have formed. The control 62 switches the brakes 60 off at the time t1 so that the front rollers 42 are released for starting. The control 62 simultaneously changes its input signal to the inverter 32 (34) from a reference frequency 0 to a low reference frequency fm of e.g. 5 Hz. The motors 40 start immediately to turn the shafts 52 but not immediately at a speed corresponding to the reference frequency fm although the clutches 56 are still disengaged at this time so that the motors 40 can temporarily run up to speed and achieve synchronism off load. However, after at most a few revolutions, every motor 40 runs in step with its reference frequency, as indicated by a horizontal portion S of the starting characteristic and this is reported to the control 62 by a sensor 66 visible in FIG. 3.

Shortly after the motors 40 have been thus synchronized, the control 62 engages all the clutches 56 simultaneously at the time t2. The motor shafts 52 now experience the load of their associated and so far stationary rollers. An abrupt loading of this kind of a motor that has already started might easily cause the motor to fall out of step with the reference frequency. To prevent this, the two transmissions 54, 58 are effective as power converters to convert the relatively high moment of inertia of a stationary drafting roller that such moment has a relatively low effective value on the shaft 52, a substantial reduction of the effective value being achieved by the transmission 58 at the input of the clutch 56.

In order to ensure that, during the clutching phase the relative speed of the initially stationary shaft 42(50) and the already rotating shaft 52 is as small as possible, the high motor speed is reduced to a relatively low value via the belt transmission.

Thus, the effective moment of inertia of the new load as compared with the motor capacity can at least be mastered by the motor 40 and is preferably negligible This feature helps to reduce costs without considerable over-dimensioning of the motor 40 to deal with the acceleration load. The drafting rollers 42, 44, 46 start to rotate similarly around their longitudinal axis, all of them being rotated by way of the associated transmissions, determined by the reference frequency, the speed being, for example, the speed D of FIG. 4—i.e., in a predetermined speed relationship to one another and to the spindles. After a short steadying time at this relatively low speed, the reference frequency is increased by the control 62 in accordance with a preprogrammed acceleration curve HK so that all the drives of the machine are brought to their operating speed in step with one another.

At stoppage, the various drives are first slowed to a relatively low speed from their operating speed (portion A of the stop characteristic of FIG. 4). This low speed preferably corresponds to the same reference frequency as was used at starting to synchronize the motors. After a short steadying phase at this speed, the control 62 opens all the clutches 56 simultaneously at the time t3. Because of the braking actions in the drafting arrangements, all the rollers 42, 44, 46 stop immediately, something which can be synchronized by the control 62 with the run-out of the spindles (not shown). After this "load cast-off" the motors 40 can be stopped and then run freely to a standstill, stopping only, for example, at the time t4.

The brakes 60 are preferably actuated shortly after the clutches 56 release in order to prevent the rollers from turning backwards. For very short intervals of time and after the actuation of the clutches, the front rollers 42 are therefore free to rotate under the torsion effect; however, these intervals are too brief to lead to perceptible effects in the yarn.

The sensor 66 can be a pulse sensor, the control 62 counting the number of pulses produced by the transmitter 66 during a predetermined period of time. The control 62 initiates engagement of the clutches 56 only when such number of impulses corresponds to a predetermined value. As can be gathered form FIG. 4, however, the control 62 could operate the clutches 56 after a predetermined time (t1 to t2) has elapsed from the starting of the motors or after a predetermined low speed has been reached at stoppage.

The drive is not limited to features of the construction shown. The motors 40 need not necessarily be synchronous motors but should be synchronizable with a reference frequency. The reference frequency associated with the coupling of the motor with the load and the uncoupling of the motor from the load is preferably in the range of from 2 to 20 Hz. The drive enables such motors to be synchronized with their reference frequency without load-induced disturbances or problems. During these synchronization periods, the motor can work into a predetermined and not disturbing load but preferably runs up to speed off-load.

Preferably the motor speed is selected to correspond with a supply frequency not greater than 5 Hz, for two reasons:

1. the rotational energy in the rotating motor mass should be large as possible for the clutching step, to avoid causing loss of synchronism;
2. an a.c. motor of normal design usually only begins to run under controllable conditions at supply frequencies of 5 Hz and above.

The power supply systems can be adapted as required to the motors and the circumstances. The common inverters of FIG. 2 can be replaced by individual inverters. Each motor could even have its own inverter without intermediate circuit.

The invention provides a drive system with advantages mainly where a load must be accelerated from a standstill "with gear accuracy"—i.e., the load must make predetermined rotary movements but a mechanical form or power transmission is unsatisfactory or at least undesirable, particularly when a number of such loads have to be accelerated from a standstill simultaneously and in a predetermined relationship to one another.

What is claimed is:

1. A ring spinning machine comprising a plurality of rotatable spindles;

a drafting arrangement for feeding fiber to said spindles, said arrangement including a plurality of driven rollers and at least two drive motors for each respective roller, each said motor being controlled in dependence on a supply frequency delivered thereto;

a plurality of power transmissions, each transmission being disposed for coupling a respective motor with a respective roller driven thereby and including a clutch, a first gear transmission between a respective motor and said clutch, and a second gear transmission between said clutch and said roller; and a control for supplying an individual supply frequency to each said motor, said control being operatively connected to said clutch of each power transmission to couple said motors simultaneously with said rollers in response to said motors reaching a speed to run in synchronism with the supply frequency delivered thereto.

2. A spinning machine as set forth in claim 1 which further comprises a brake in at least one power transmission between said clutch thereof and said roller connected thereto, said control being operatively connected to said brake to engage said brake to stop said roller after de-coupling of said clutch.

3. A spinning machine as set forth in claim 1 which further comprises a supply mains, a first drive system for driving said spindles and including a common convertor and a plurality of electric motors, each electric motor being connected to and between a respective spindle and said convertor for driving of said electric motor at a speed determined by said convertor independently of said control for said motors of said drafting arrangement.

4. A ring spinning machine comprising a plurality of spinning stations;

a first drive system for driving said spinning stations;

a drafting arrangement including a plurality of rollers;

a second drive system for driving said rollers of said drafting arrangement independently of said first drive system, said second drive system including at least one motor for driving one of said rollers, a first gear transmission operatively connected to said motor, a second gear transmission connected to said one roller and a clutch between said transmission for selectively connecting said transmissions in driving engagement; and a control for controlling a supply frequency supplied to said motor for driving said motor, said control being connected to said clutch to activate said clutch to connect said transmissions to each other in response to said one motor reaching a speed in synchronism with said supply frequency.

5. A spinning machine as set forth in claim 4 wherein said motor is a synchronous motor.

6. A spinning machine as set forth in claim 5 which further comprises an inverter for converting DC energy into AC energy of predetermined frequency for driving said motor, said control being connected to said inverter to effect a start up of said motor at a low frequency prior to actuation of said clutch.

7. A spinning machine as set forth in claim 4 which further comprises a brake between said clutch and said roller for braking rotation of said roller, said control being connected to said brake to engage said brake after de-actuation of said clutch.

8. A ring spinning machine comprising a plurality of spinning stations;

a first drive system for driving said spinning stations;

a drafting arrangement including a plurality of rollers;

a second drive system for driving said rollers of said drafting arrangement independently of said first drive system, said second drive system including at least two pairs of motors for driving at least two of said rollers, a plurality of first gear transmissions, each transmission being connected to a respective one of said motors, a plurality of second gear transmissions, each second transmission being connected to a respective one of said rollers, a plurality of clutches, each clutch being connected between a respective first transmission and a respective second transmission for selectively connecting said transmissions in driving engagement; and a control for controlling a supply frequency to each motor for driving said motors in synchronism, said control being connected to said clutches to activate said clutches simultaneously in response to said motors reaching a speed in synchronism with said supply frequency.

9. A spinning machine as set forth in claim 8 wherein each motor is a synchronous motor.

10. A spinning machine as set forth in claim 8 which comprises a brake between one of said clutches and one of said rollers for braking rotation of said roller, said control being connected to said brake to engage said brake after de-actuation of said clutches.

* * * * *

UNITED STATES PATENT AND TRADEMARK OFFICE

CERTIFICATE OF CORRECTION

PATENT NO. : 5,015,938

DATED : May 14, 1991

INVENTOR(S) : Reinhard Oehler, et al

It is certified that error appears in the above-identified patent and that said Letters Patent is hereby corrected as shown below:

Column 2, line 30 change "a" to -at- (first occurrence)

Column 7, lines 54, 55 change "transmitter" should be -sensor-

Signed and Sealed this

Eighth Day of December, 1992

*Attest:*

DOUGLAS B. COMER

*Attesting Officer*

*Acting Commissioner of Patents and Trademarks*